US006960070B2

(12) United States Patent
Kammhoff et al.

(10) Patent No.: US 6,960,070 B2
(45) Date of Patent: Nov. 1, 2005

(54) COMPRESSOR

(75) Inventors: Karl-Friedrich Kammhoff, Weil der Stadt (DE); Gernot Balz, Schoenaich (DE); Christian Scharer, Gaggenau (DE)

(73) Assignee: Bitzer Kuehlmaschinenbau GmbH, Sindelfingen (DE)

( * ) Notice: Subject to any disclaimer, the term of this patent is extended or adjusted under 35 U.S.C. 154(b) by 0 days.

(21) Appl. No.: 10/682,304

(22) Filed: Oct. 8, 2003

(65) Prior Publication Data

US 2004/0126261 A1 Jul. 1, 2004

(30) Foreign Application Priority Data

Oct. 15, 2002 (DE) ..... 102 48 926

(51) Int. Cl.[7] ..... F03C 2/00

(52) U.S. Cl. ..... 418/55.6; 418/55.1; 418/94; 418/270; 418/DIG. 1; 417/366; 417/410.5; 184/6.18

(58) Field of Search ..... 418/55.1, 55.6, 418/94, 270, DIG. 1; 417/366, 368, 410.5; 184/6.18

(56) References Cited

U.S. PATENT DOCUMENTS

| | | | | |
|---|---|---|---|---|
| 4,496,293 A | * | 1/1985 | Nakamura et al. | 418/55.6 |
| 4,564,339 A | | 1/1986 | Nakamura et al. | |
| 4,575,320 A | | 3/1986 | Kobayashi et al. | |
| 4,592,703 A | * | 6/1986 | Inaba et al. | 418/55.6 |
| 6,364,645 B1 | | 4/2002 | Dieterich | |
| 2003/0031570 A1 | | 2/2003 | Kammhoff et al. | |

FOREIGN PATENT DOCUMENTS

| | | | | |
|---|---|---|---|---|
| DE | 198 45 993 | | 4/2000 | |
| EP | 0 798 465 | | 10/1997 | |
| JP | 59176494 A | * | 10/1984 | ..... F04C 29/02 |
| WO | 02/052205 | | 7/2002 | |

OTHER PUBLICATIONS

*Patent Abstracts of Japan*, vol. 1999, No. 01, "Scroll Compressor", Publication No. 10-274178, Oct. 13, 1998.

*Patent Abstracts of Japan*, vol. 2000, No. 15, "Scroll Compressor", Publication No. 2000-345978, Dec. 12, 2000.

* cited by examiner

*Primary Examiner*—Theresa Trieu
(74) *Attorney, Agent, or Firm*—Lipsitz & McAllister, LLC

(57) ABSTRACT

In order to improve a compressor for refrigerant, comprising an outer housing, a scroll compressor arranged in the outer housing and having a first compressor member arranged stationarily in the outer housing and a second compressor member which is movable relative to the first compressor member, the compressor members each having a base and first and second scroll ribs, respectively, which rise above the respective base and engage in one another such that the second compressor member is movable relative to the first compressor member on an orbital path about a central axis for the purpose of compressing the refrigerant, a drive unit for the second compressor member having an eccentric drive, a drive shaft, a drive motor arranged in a motor housing and having drawn-in refrigerant flowing around it as well as a bearing unit for the drive shaft which comprises a first bearing member connected to the outer housing, in such a manner that the refrigerant drawn in by the scroll compressor is free from lubricating oil to as great an extent as possible it is suggested that the refrigerant flow through an oil separator, which is arranged in the outer housing between this and the drive unit, after flowing around the drive motor and prior to entering the scroll compressor.

35 Claims, 6 Drawing Sheets

124
36
126
32
22
210
212
44
40
20
16
26
34
18
24
72
62
50
64
132
74
134
66
136
130
128
68
142
140
10
102
86
100
90
88
54
104
52
96
122
178
92
116
98
120
114
110
118
46

COMPRESSOR

The present disclosure relates to the subject matter disclosed in German application No. 102 48 926.2 of Oct. 15, 2002, which is incorporated herein by reference in its entirety and for all purposes.

BACKGROUND OF THE INVENTION

The invention relates to a compressor for refrigerant, comprising an outer housing, a scroll compressor arranged in the outer housing and having a first compressor member arranged stationarily in the outer housing and a second compressor member movable relative to the first compressor member, these compressor members each having a base and first and second scroll ribs, respectively, which rise above the respective base and engage in one another such that the second compressor member is movable relative to the first compressor member on an orbital path about a central axis for the purpose of compressing the refrigerant, a drive unit for the second compressor member with an eccentric drive, a drive shaft, a drive motor arranged in a motor housing and having drawn-in refrigerant flowing around it as well as a bearing unit for the drive shaft which comprises a first bearing member connected to the outer housing.

A compressor of this type is known, for example, from U.S. Pat. No. 4,564,339. The problem with compressors of this type is that oil carried along by the refrigerant which is drawn in still enters the scroll compressor and leads to problems in it.

The object underlying the invention is, therefore, to improve a compressor of the generic type in such a manner that the refrigerant drawn in by the scroll compressor is free from lubricating oil to as great an extent as possible.

SUMMARY OF THE INVENTION

This object is accomplished in accordance with the invention, in a compressor of the type described at the outset, in that the refrigerant flows through an oil separator, which is arranged in the outer housing between this and the drive unit, after flowing around the drive motor and prior to entering the scroll compressor.

The advantage of this solution is to be seen in the fact that a possibility has been created, as a result of this additional oil separator, of separating the oil already carried along with the refrigerant drawn in and also the oil entrained by the refrigerant whilst flowing through the drive motor to a sufficiently large extent prior to it entering the scroll compressor in order to avoid the problems in the scroll compressor caused by oil.

With respect to as compact a construction of the inventive compressor as possible, it has proven to be advantageous when the oil separator is arranged in a space located between the outer housing and the drive unit in a direction transverse to the central axis since the constructional length, in particular, of the compressor is not altered as a result.

Furthermore, it has proven to be particularly advantageous when the space between the outer housing and the drive unit extends essentially over the entire extension of the drive unit in a direction parallel to the central axis.

As a result, the space could still be arranged on one side of the drive unit. With respect to available space which is as large as possible, it is particularly expedient when the space surrounds the drive unit and, therefore, extends around the drive unit on all sides in order to obtain an optimum utilization of free space in the outer housing.

The space is, in this respect, used not only for the arrangement of the oil separator but rather, preferably, in many ways. An expedient solution provides for oil separated by the oil separator in the space to move in the direction of the oil sump and for refrigerant to flow in the direction of an intake chamber of the scroll compressor. Such an arrangement utilizing the space in various ways allows a particularly compact construction of the inventive compressor.

With respect to the guidance of the refrigerant, it has proven to be particularly expedient when the refrigerant enters the space after cooling the drive motor.

With respect to as favorable an arrangement of the oil separator as possible, it is provided for the oil separator to be arranged, at least in sections, on an outer side of the first bearing member since, in this area, suitable space is available.

The oil separator may be arranged in a particularly favorable manner when it surrounds the first bearing member at least in sections.

A further, favorable arrangement in addition or alternatively to the arrangement of the oil separator on the outer side of the bearing member provides for the oil separator to be arranged, at least in sections, on an outer side of the motor housing since, in this area, a lot of space can be made available without considerably increasing the constructional size of the compressor. In this respect, it is particularly advantageous when the oil separator surrounds the motor housing at least in sections.

With respect to the actual design of the oil separator, one preferred embodiment provides for the oil separator to use part of the space located between the outer housing and the drive unit.

It has proven to be particularly favorable when the space between the outer housing and the drive unit used by the oil separator is an annular space.

With respect to the arrangement of the oil separator in the space, no further details have so far been given. It is preferably provided, for example, for the oil separator to be located on a side facing an oil sump of supporting arms which connect the first bearing member to the outer housing in order to arrange the oil separator in a favorable manner at an adequately large distance from the intake chamber of the scroll compressor.

Furthermore, it is particularly favorable when the oil separator is arranged in front of an exit opening for the refrigerant provided in the motor housing in order to achieve a good utilization of space.

With respect to the guidance of the refrigerant in the oil separator, no further details have been given in conjunction with the preceding explanations concerning the individual embodiments. One particularly favorable solution provides for the refrigerant to experience a deflection in an azimuthal direction in relation to the central axis when entering the oil separator since, as a result, a particularly effective separation of oil is brought about due to the forces acting on the drops of oil and extending transversely to the direction of flow.

It is particularly favorable when the refrigerant experiences the deflection in the at least one azimuthal direction as a result of a deflection element. One particularly advantageous solution provides for the refrigerant to experience a deflection in opposite azimuthal directions.

It is, moreover, favorable for the further, optimum separation of oil when the refrigerant is guided in the oil separator essentially on an azimuthal path around the central axis.

One embodiment of an oil separator which is particularly simple from a constructional point of view provides for the refrigerant to flow in the oil separator along an inner wall surface of the outer housing and, therefore, always be deflected in an azimuthal direction in relation to the central axis, in particular, in the case of a cylindrical outer housing.

A particularly simple guidance of the oil deposited in the oil separator provides for the oil settling in the oil separator to move into the oil sump on a path extending outside the motor housing in order to prevent the refrigerant cooling the drive motor from again picking up oil and transporting it to the oil separator.

With respect to the arrangement of the oil sump, no further details have so far been given. The inventive compressor is advantageously designed as a compressor working with a central axis aligned essentially vertical so that the oil sump is arranged in the outer housing on a side of the drive motor located opposite the first bearing member.

With respect to the arrangement of the oil separator, no further details have so far been given. One particularly favorable solution provides, for example, for the refrigerant to flow around an outer side of the first bearing member on its way from the oil separator to the intake chamber of the scroll compressor in order to cool the first bearing member. In this respect, a large distance between the intake chamber and the oil separator can also preferably be realized.

A particularly favorable solution provides for the oil separator to be located on a side facing an oil sump of supporting arms which connect the first bearing member to the outer housing.

A particularly favorable embodiment with respect to the guidance of the refrigerant provides for the refrigerant to pass between the supporting arms in the direction of the intake chamber of the scroll compressor after flowing through the oil separator.

With respect to the guidance of the refrigerant drawn in by the compressor in the compressor itself, no further details have so far been given. It would, for example, be conceivable to have the refrigerant enter the outer housing first of all and then to guide it to the motor housing via indirect routes.

It has, however, proven to be particularly advantageous when the refrigerant flows directly into the motor housing when entering the compressor and enters the oil separator after flowing through the motor housing. As a result, it is possible to introduce the refrigerant into the motor housing in a concerted manner and avoid additional indirect routes.

In this respect, it is particularly favorable when the refrigerant entering the motor housing experiences a deflection in at least one azimuthal direction.

It is even better when the refrigerant experiences a deflection in opposite azimuthal directions and, therefore, flows through an interior space of the motor housing as a result of azimuthal flows extending in opposite directions.

With respect to an optimum cooling effect in the drive motor, it has proven to be particularly expedient when the refrigerant enters the motor housing at the level of a first winding head when seen in the direction of the central axis.

The refrigerant is expediently guided in the motor housing, when seen in the direction of the central axis, such that it flows through the drive motor from the first winding head in the direction of a second winding head.

In order to guide the refrigerant as favorably as possible it is provided for the refrigerant to exit from the motor housing at the level of the second winding head when seen in the direction of the central axis.

With this solution it is not described in greater detail where the first winding head and the second winding head are located.

With one inventive solution, the first winding head is arranged such that this is the winding head of the drive motor which is located on a side facing away from the first bearing member whereas in another embodiment the winding head is the winding head of the drive motor which is located on a side facing the first bearing member.

With respect to the guidance of oil separating in the motor housing to the oil sump, no further details have so far been given. One advantageous solution provides, for example, for oil separating in the motor housing to exit from the motor housing through oil discharge openings of a second bearing member which forms a base of the motor housing in order to reach the oil sump.

In order, in addition, to also drain off oil running out of the eccentric drive on account of the lubrication in a concerted manner, it is preferably provided for the first bearing member to have an oil guide means for oil used for the lubrication of the eccentric drive.

This oil guide means may be designed in the most varied of ways. One advantageous solution, for example, provides for the oil guide means to open into an interior space of the motor housing so that the oil drawn off by the oil guide means enters the interior space of the housing.

In this respect, considerable portions of the oil are expediently conveyed to the oil separator by the refrigerant flowing through the interior space of the motor housing in order to supply the oil to the oil sump via the oil separator in this way.

An alternative solution provides for the oil guide means to open into the intermediate space and, therefore, preferably into the oil separator.

With respect to the conveyance of the lubricating oil to the individual bearings of the inventive compressor to be lubricated, no further details have so far been given. It is preferably provided for the drive shaft to have a bore for lubricating oil, through which the lubricating oil can advantageously be supplied to the respective bearings.

In this respect, the bore for lubricating oil is expediently designed such that a lubrication of a rotary bearing for the drive shaft in the first bearing member is brought about via this bore.

Furthermore, the bore for lubricating oil is preferably designed such that a lubrication of the eccentric drive is brought about via this bore.

With respect to an optimum mounting of the drive shaft in the inventive compressor, it has merely been established thus far that the drive shaft is mounted in the first bearing member, preferably close to the eccentric drive.

A particularly favorable solution provides for the drive shaft to be mounted, in addition, in a second bearing arranged at a distance from the first bearing member.

In this respect, the second bearing member is expediently arranged on a side of the drive motor located opposite the first bearing member.

With respect to the fixing of the second bearing member in the inventive compressor, it has proven to be favorable when the second bearing member is connected to the first bearing member via the motor housing so that a precise alignment of the first bearing member and the second bearing member is possible by means of the motor housing with a simple assembly.

A solution which is expedient with respect to the simplicity of the construction of the motor housing provides for the second bearing member to form a base of the motor housing.

Additional features and advantages of the design of the invention are the subject matter of the following description as well as the drawings illustrating several embodiments.

DETAILED DESCRIPTION OF THE INVENTION

Figure 1:
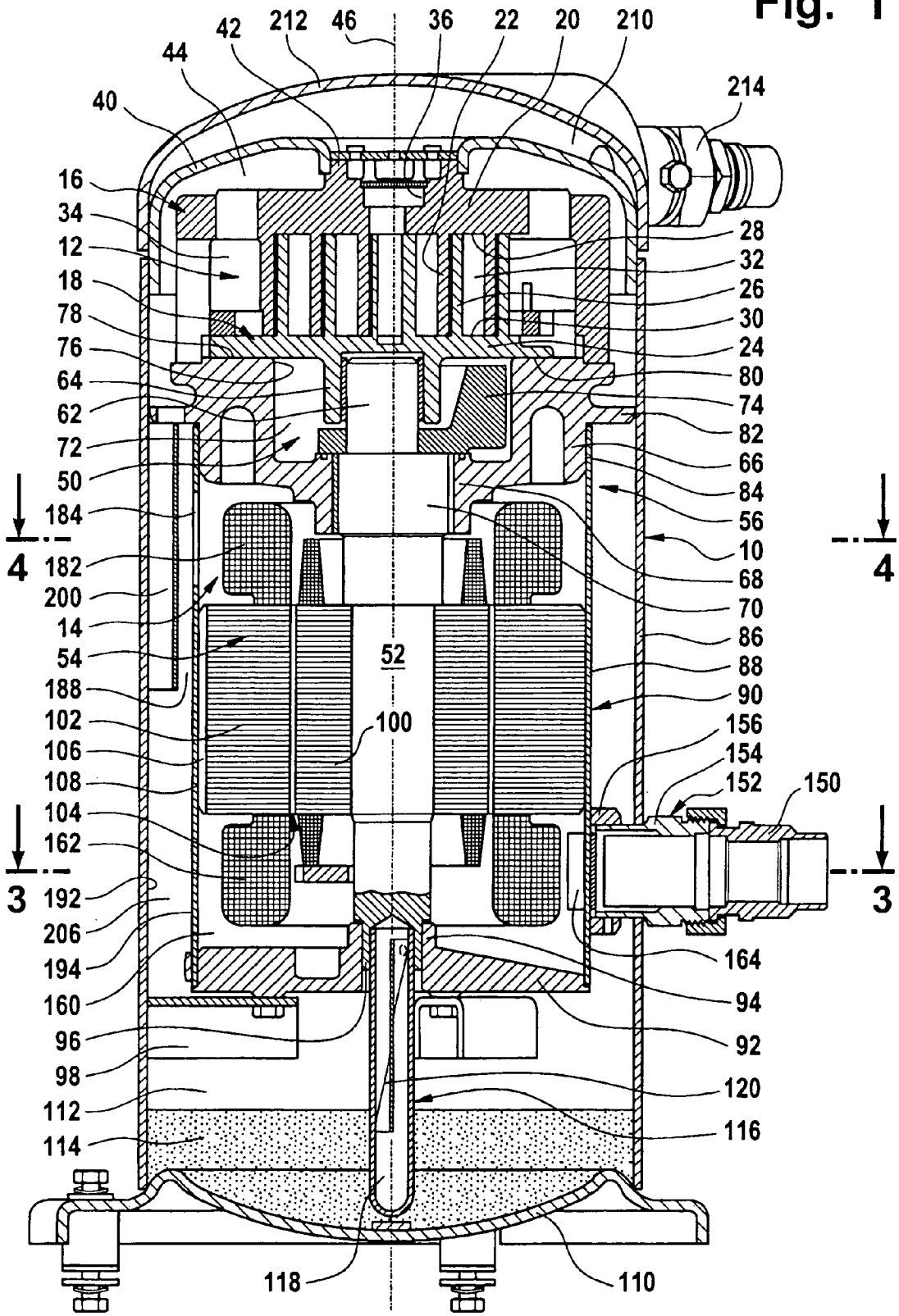
FIG. 1 shows a longitudinal section through a first embodiment of an inventive compressor.
Figure 2:
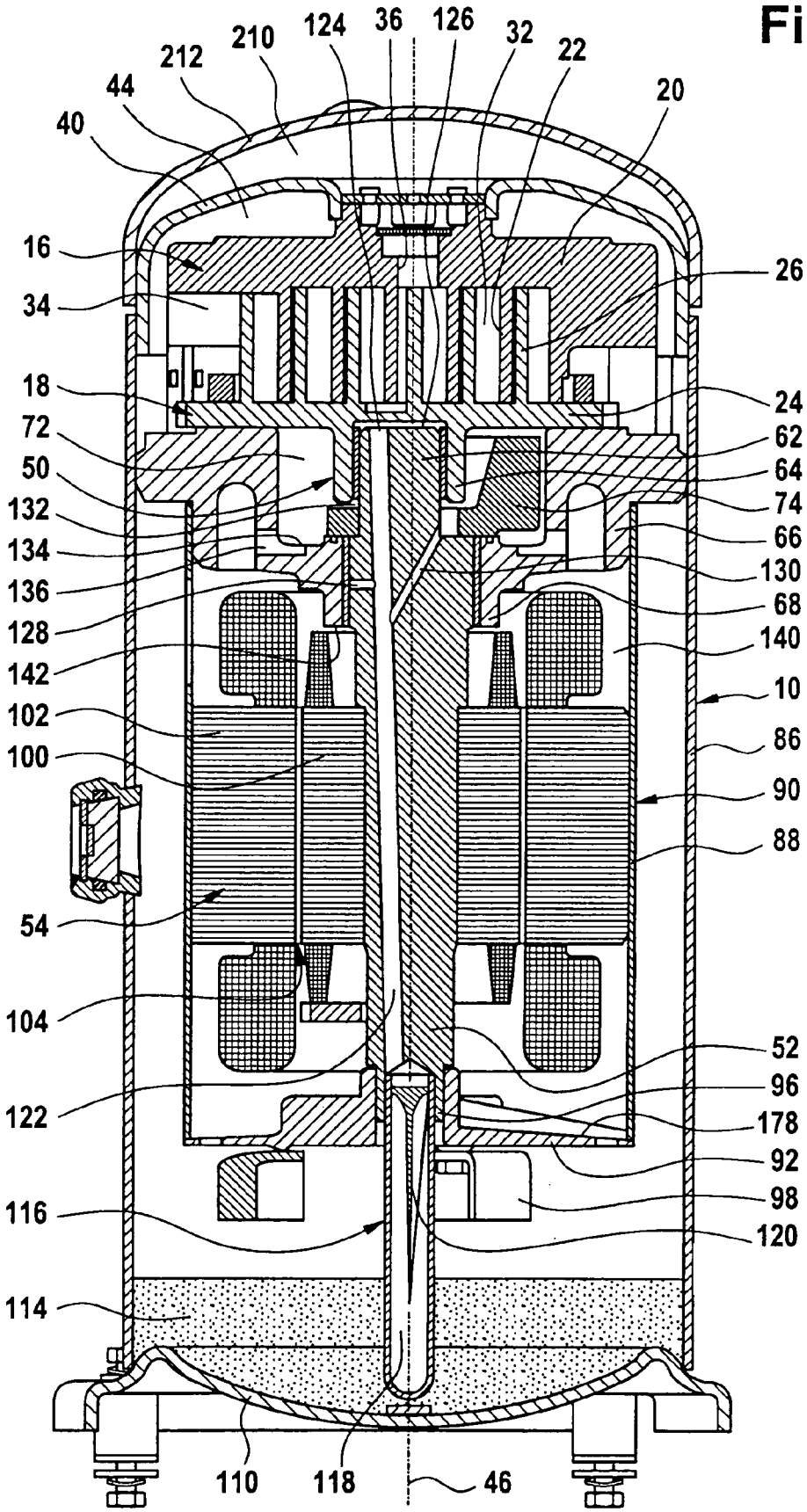
FIG. 2 shows a longitudinal section through the first embodiment of the inventive compressor turned through an angle of approximately 90°.

A first embodiment of an inventive compressor, illustrated in FIGS. 1 to 5, comprises an outer housing which is designated as a whole as 10 and in which a scroll compressor, which is designated as a whole as 12 and can be driven by a drive unit designated as a whole as 14, is arranged.

The scroll compressor 12 comprises a first compressor member 16 and a second compressor member 18, wherein the first compressor member 16 has a first scroll rib 22 which rises above a base 20 of the first compressor member and is designed in the form of a circular involute and the second compressor member 18 has a second scroll rib 26 which rises above a base 24 of the second compressor member and is designed in the form of a circular involute, wherein the scroll ribs 22, 26 engage in one another and abut sealingly on the base surface 28 and 30, respectively, of the respectively other compressor member 18, 16 so that chambers 32 are formed between the scroll ribs 22, 26 as well as the base surfaces 28, 30 of the compressor members 16, 18, in which a compression of a refrigerant takes place which flows in with an initial pressure via an intake area 34 surrounding the scroll ribs 22, 26 radially outwards and following the compression in the chambers 32 exits via an outlet 36, provided in the base 20 of the first compressor member 16, compressed at high pressure.

In the case of the first embodiment described, the first compressor member 16 is held securely in the outer housing 10, namely by means of a dividing member 40 which is held, for its part, on the outer housing 10 within the same, engages over the base 20 of the first compressor member 16 at a distance and is connected sealingly to an annular flange 42 of the first compressor member 16 which extends around the outlet 36 and projects above the base 20 on a side located opposite the scroll rib 26.

As a result, a cooling chamber 44 for cooling the base 20 of the first compressor member 16 is formed between the base 20 of the first compressor member 16 and the dividing member 40 and this is the subject matter, for example, of WO 02/052205 A2, to which reference is made in full with respect to the cooling of the scroll compressor 12.

In contrast to the first compressor member 16, the second compressor member 18 is movable about a central axis 46 on an orbital path relative to the first compressor member 16, wherein the scroll ribs 22 and 26 abut theoretically on one another along a contact line and the contact line likewise moves about the central axis 46 during the movement of the second compressor member 18 on the orbital path.

The second compressor member 18 is driven on the orbital path about the central axis 46 by the drive unit 14 already mentioned which comprises an eccentric drive 50, a drive shaft 52 driving the eccentric drive 50, a drive motor 54 as well as a bearing unit 56 for the mounting of the drive shaft 52.

In detail, the eccentric drive 50 is formed by an entraining member 62 which is arranged eccentrically on the drive shaft 52 and, therefore, eccentrically in relation to the central axis 46 and engages in an entraining member receiving means 64 connected to the base 24 of the second compressor member 18 in order to move the second compressor member 18 on the orbital path about the central axis 46.

The bearing unit 56 comprises, for its part, a first bearing member 66 which represents a main bearing member and mounts the drive shaft 52 in an area 70 with a bearing section 68 and which bears the entraining member 62, wherein the entraining member 62 is preferably arranged in one piece on the area 70.

Furthermore, the first bearing member 66 encloses a space 72, in which the eccentric drive 50 is arranged and in which a counterbalance 74 securely connected to the drive shaft 52 moves.

Moreover, the first bearing member 66 extends to the side of the space 72 in the direction of the base 24 of the second compressor member 18 and has bearing surfaces 78 which extend around an opening 76 of the space 72 facing the second compressor member 18 and on which the second compressor member 18 rests with a rear side 80 located opposite the second scroll rib 26 and is, therefore, supported such that the second compressor member 18 is secured against any movement away from the first compressor member 16 as a result.

The first bearing member 66 is fixed in the outer housing 10 by way of supporting arms 82 which extend radially from the first bearing member 66 as far as the outer housing 10 and hold the first bearing member 66 in it in a precise manner.

The first bearing member 66 has, in addition, on a side located opposite the supporting arms 82 an outer surface 84, on which a casing 88 of a motor housing 90 is seated, which extends within and at a distance from a cylindrical section 86 of the outer housing 10, is likewise preferably cylindrical and extends as far as a second bearing member 92 which forms a base of the motor housing 90, is arranged at a distance from the first bearing member 66 and forms a bearing section 94, in which the drive shaft 52 is mounted with an end area 96 coaxially to the central axis 46.

For additional stabilization, the second bearing member 92 is supported on the outer housing 10, in addition, via support members 98.

The entire motor housing 90 therefore extends within the cylindrical section 86 of the outer housing 10 and at a distance to it.

The drive motor 54, which comprises a rotor 100 seated on the drive shaft 52 and a stator 102 surrounding the rotor 100, is arranged in the motor housing 90 between the first bearing member 66 and the second bearing member 92, wherein the stator 102 is held by the casing 88 of the motor housing 90 so as to be fixed in a stable manner relative to the outer housing 10 and so a customary gap 104 exists between the rotor 100 and the stator 102.

In addition, the stator 102 is provided on its side facing the casing 88 with cooling channels 106 which extend in the stator 102 over its entire contact side 108 parallel to the central axis 46 in the form of, for example, outer grooves, wherein the stator 102 is supported on the casing 88 via the contact side 108.

A free space 112 is provided between the second bearing member 92 and a base part 110 of the outer housing 10 and this offers the possibility, in the case of an outer housing 10 rising above the base part 110 with a central axis 46 extending approximately vertical, of forming an oil sump 114, in which, on the one hand, lubricating oil collects on account of the force of gravity and, on the other hand, lubricating oil is kept ready for the lubrication of the inventive compressor.

An oil conveyor pipe 116 extending from the end area 96 of the drive shaft 52 and coaxially to it dips into the oil sump 114 and this pipe has a conveyor blade 120 in its interior 118 and therefore acts as an oil pump which pumps oil out of the oil sump 114 into a channel 122 for lubricating oil which passes through the drive shaft 52 and allows lubricating oil to exit via an opening 124 on an end side 126 of the entraining member 62 in order to lubricate a rotary bearing formed between the entraining member receiving means 64 and the entraining member 62 for the movement of the second compressor member 18 on the orbital path.

Furthermore, a transverse channel 128 branches off from the channel 122 for lubricating oil and this transverse channel leads to the rotary bearing formed between the bearing section 68 of the first bearing member 66 and the area 70 of the drive shaft 52 and lubricates it and, finally, a venting channel 130 branches off from the channel 122 for lubricating oil.

The oil used for the lubrication of the entraining member 62 in the entraining member receiving means 64 leaves the entraining member receiving means 64 in the area of an opening 132 of the entraining member receiving means 64 which faces the area 70, then reaches a base 134 of the space 70 which is formed by the first bearing member 66 and from there passes via discharge channels 136, which form an oil guide means with the base 134, into an upper interior space 140 of the motor housing 90. Furthermore, the oil which serves to lubricate the area 70 of the drive shaft 52 in the bearing section 68 exits from the bearing section 68 at an underside 142 thereof and, therefore, also enters the upper interior space 140 of the motor housing 90.

The refrigerant to be compressed by the scroll compressor 12 is supplied to the inventive compressor via an intake line 150 which is guided to an intake connection 152 which, for its part, is held on the outer housing 10 but is guided through this as far as the motor housing 90.

Figure 3:
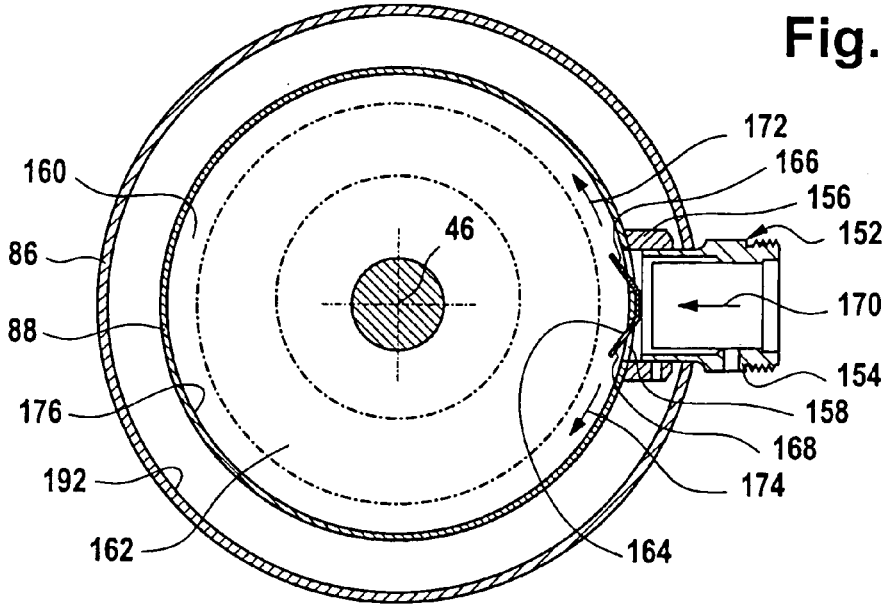
FIG. 3 shows a section along line 3—3 in FIG. 1.

The intake connection 152 preferably has a sleeve 154 which passes through the outer housing 10 of the inventive compressor and engages in a receiving means 156 connected securely to the casing 88 of the motor housing 90, as illustrated in FIGS. 1 and 3. The receiving means 156 encloses an inlet 158 for the refrigerant provided in the casing 88 so that the refrigerant can pass directly into a lower interior space 160 of the motor housing 90 which is located between the stator 102 and the second bearing member 92.

Furthermore, the inlet opening 158 is arranged in the direction of the central axis 46 such that the refrigerant enters the lower interior space 160 at the level of a winding head 162 of the stator 102 which likewise projects into the interior space 160.

Figure 5:
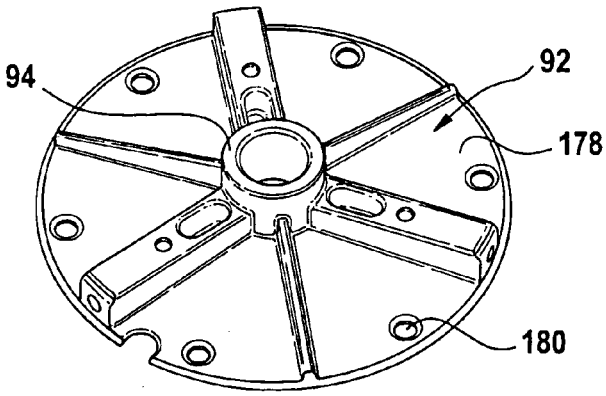
FIG. 5 shows a plan view of a base of a second bearing part forming a motor housing.

For the optimum distribution of the refrigerant in the lower interior space 160, a deflection unit 164 is associated with the inlet 158 and this has two deflection surfaces 166 and 168 which deflect the refrigerant flowing through the sleeve 154 approximately in a radial direction 170 in relation to the central axis 46 such that main directions of flow of the gaseous refrigerant supplied extend around the winding head 162 in two opposite azimuthal directions 172 and 174 in relation to the central axis 46, namely within the casing 88, the inner wall 176 of which guides the refrigerant propagating in the azimuthal directions 172 and 74 further and contributes to the fact that oil carried along with the refrigerant supplied is separated at the inner wall 176 and runs downwards along this wall in the direction of the second bearing member 92 illustrated in detail in FIG. 5, wherein the bearing member 92 also forms the base 178 which essentially closes the casing 88 and is, however, provided with oil discharge openings 180, from which the separated oil can flow into the oil sump 114.

As a result of the closed base 178, the refrigerant entering the lower interior space 160 of the motor housing 90 essentially does not have the possibility of passing into the free space 112 between the second bearing member 92 and the base part 110 but rather remains essentially in the interior space 160 for the purpose of cooling the winding head 162 and then, proceeding from the interior space 160, passes through the cooling channels 106 and the gap 104 between the rotor 100 and the stator 102 into the upper interior space 140 which is located between the first bearing member 66 and the stator 102 in order to cool the winding heads 182 projecting into the upper interior space 140.

Figure 4:
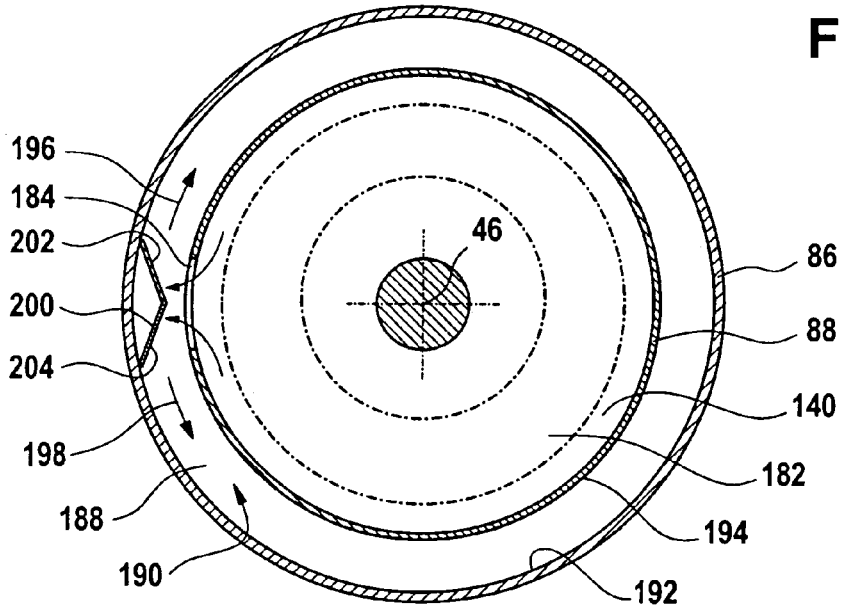
FIG. 4 shows a section along line 4—4 in FIG. 1.

At least one exit opening 184 is provided in the casing 88, as illustrated in FIGS. 1 and 4, at the level of the winding head 82 and the refrigerant exits from the upper interior space 140 of the motor housing 90 through this opening, namely into a space 188 which exists between the cylindrical section 88 and the first bearing member 66—apart from the supporting arms 82—and the motor housing 90 and which is part of an oil separator 190. The space 188 is, in particular, located essentially between an inner wall surface 192 of the cylindrical section 86 of the outer housing 10 and an outer wall surface 194 of the cylindrical casing 88, wherein the space 188 preferably extends as a closed annular space around the casing 88.

In order to generate a flow of the gaseous refrigerant in opposite azimuthal directions 196, 198 in the space 188, a deflection unit 200 is arranged so as to be located opposite the exit opening 184 and this deflection unit has deflection surfaces 202 and 204 which deflect the gaseous refrigerant exiting from the exit opening 184 into the azimuthal directions 196 and 198.

It is, however, also conceivable to provide several exit openings 184 opening into the space 188 and deflections units 200 associated with them in angular spaced relationship around the central axis 46.

As a result of the gaseous refrigerant being guided in the azimuthal directions 196 and 198, in particular, between the inner wall surface 192 and the outer wall surface 194, an oil separation effect occurs on account of the constantly active, radial acceleration of drops of oil in the gaseous refrigerant and this oil separation effect is displayed, in particular, by a depositing of oil, which is carried along by the refrigerant, on the inner wall surface 192 and the outer wall surface 194, wherein the oil, in the case of a compressor assembled with an essentially vertical central axis 46, can run down between the outer housing 10 and the motor housing 90 preferably along the inner wall surface 192 and the outer wall surface 194 in the direction of the oil sump 114 since a free space 206, which merges into the free space 112 proceeding from the space 188 and via which the oil can, in the end, be supplied to the oil sump 114, exists between the outer housing 10 and the motor housing 90 over the entire extension of the motor housing 90 in the direction of the central axis 46.

The separation of all the oil carried along by the refrigerant on its way through the interior space 160, through the gap 104 and the cooling channels 106 as well as the interior space 140 and also, in particular, at least partially, oil which exits at the underside 142 of the bearing section 68 and oil which has been supplied to the interior space 140 via the discharge channels 136 is brought about in the oil separator 190.

The refrigerant which is, therefore, essentially freed of oil in the oil separator 190 flows, proceeding from the space 188 of the oil separator 190, between the supporting arms 82 and, therefore, past the first bearing member 66 on the outside in the direction of the intake area 34 of the scroll compressor 12 and is taken in by this and compressed, wherein the compressed refrigerant, via the outlet 36, enters a pressure chamber 210, which is located between a cover 212 of the outer housing 10 and the dividing member 40, and is discharged from this through a pressure connection 214.

Figure 6:
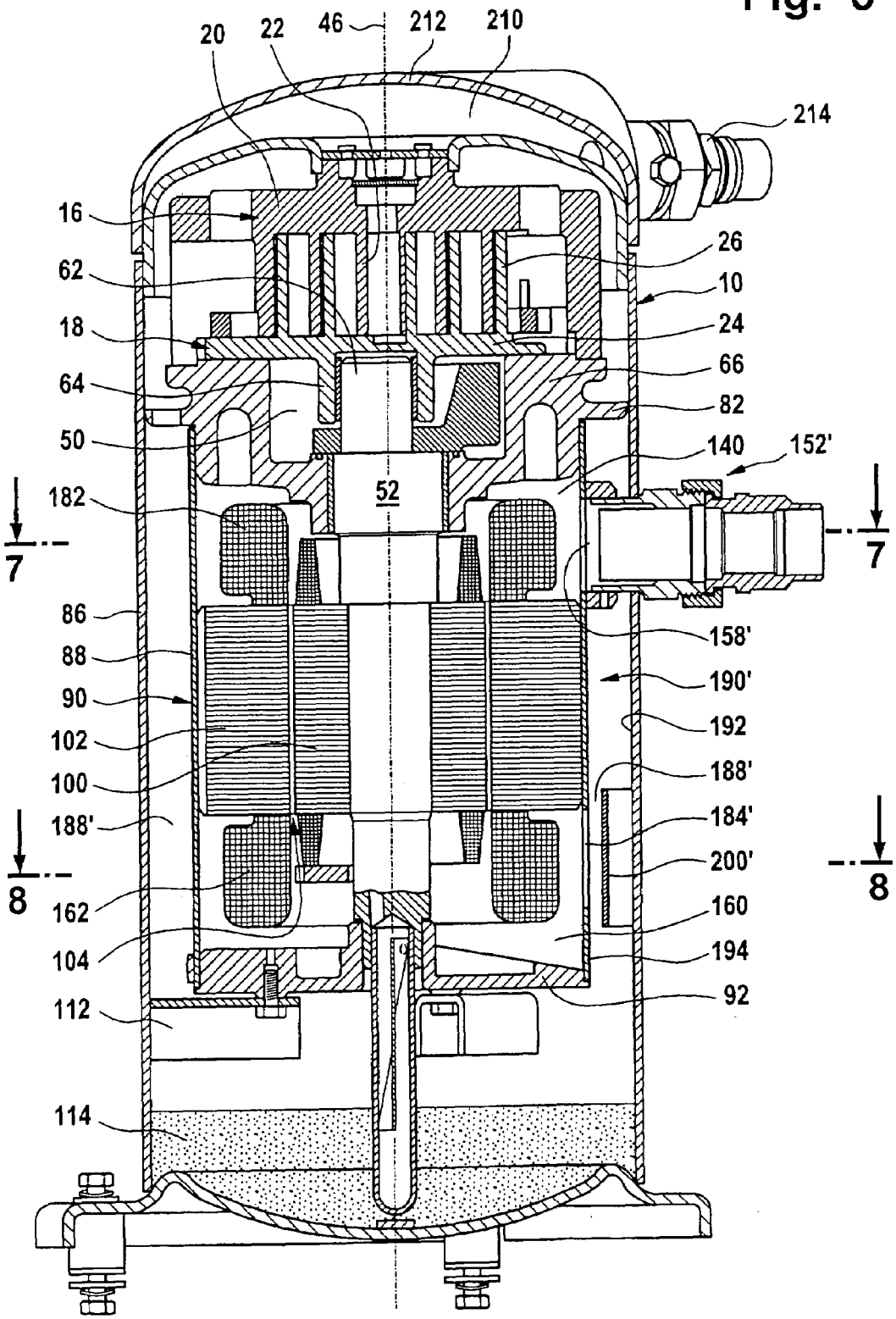
FIG. 6 shows a view similar to FIG. 1 of a second embodiment of an inventive compressor.
Figure 7:
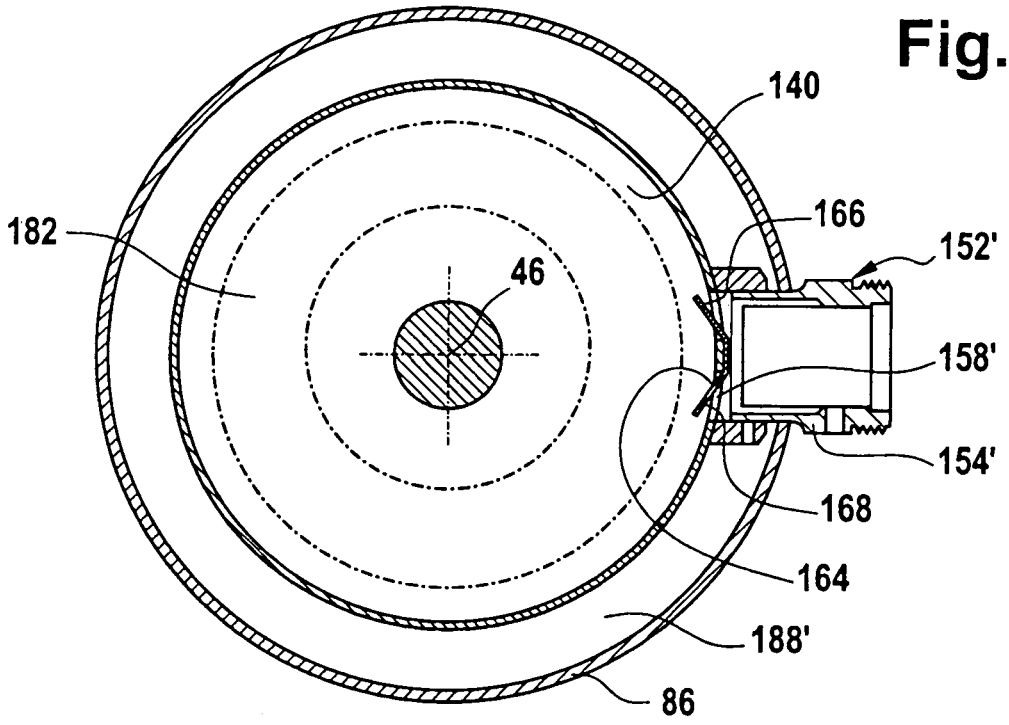
FIG. 7 shows a section along line 7—7 in FIG. 6.
Figure 8:
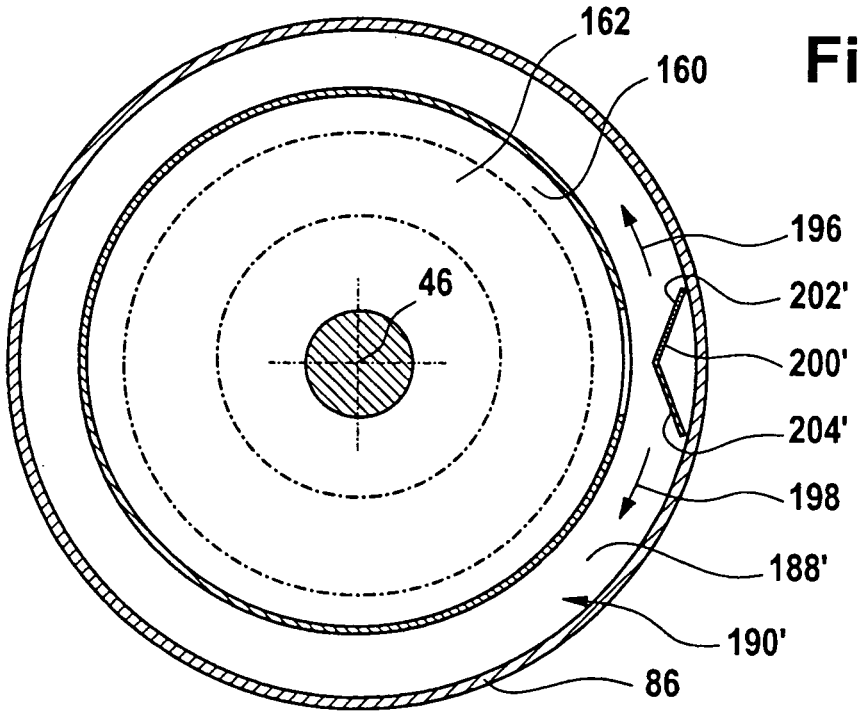
FIG. 8 shows a section along line 8—8 in FIG. 6.

In a second embodiment of the inventive compressor, illustrated in FIGS. 6 to 8, those parts which are identical to those of the first embodiment are given the same reference numerals and so, in this respect, reference is made in full to the comments concerning the first embodiment.

In contrast to the first embodiment, the intake connection 152' of the second embodiment is arranged such that the inlet 158' is located at the level of the winding head 182 of the stator 102 and, therefore, the refrigerant supplied enters the upper interior space 140 within the motor housing 90 first of all, then enters the lower interior space 160 likewise through the gap 104 between the rotor 100 and the stator 102 and cooling channels 106 likewise provided in order to cool the winding head 162 in this interior space.

In this embodiment, the exit opening 184' is, therefore, located at the level of the winding head 162, and thus the space 188' between the inner wall surface 192 of the outer housing 10 and the outer wall surface 194 of the casing 88 at the level of the exit opening 184' in relation to the central axis 46, but the space 188' and, therefore, the oil separator 190' extend, when seen in the direction of the central axis 46, over the entire length of the casing 88 as far as the supporting arms 82 of the first bearing member 66 and so, when seen in the direction of the central axis 46, a longer space is available between the outer housing 10 and the casing 88 for the separation of oil.

In addition, a deflection unit 200', the deflection surfaces 202' and 204' of which likewise effect a deflection of the exiting refrigerant in the azimuthal directions 196 and 198 in the space 188', is likewise associated with the exit opening 184' and located opposite it.

Since the space 188' is essentially connected directly to the free space 112, the oil separating in the oil separator 190' has the possibility of entering the free space 112 without any problem and, from there, passing into the oil sump 114.

Figure 9:
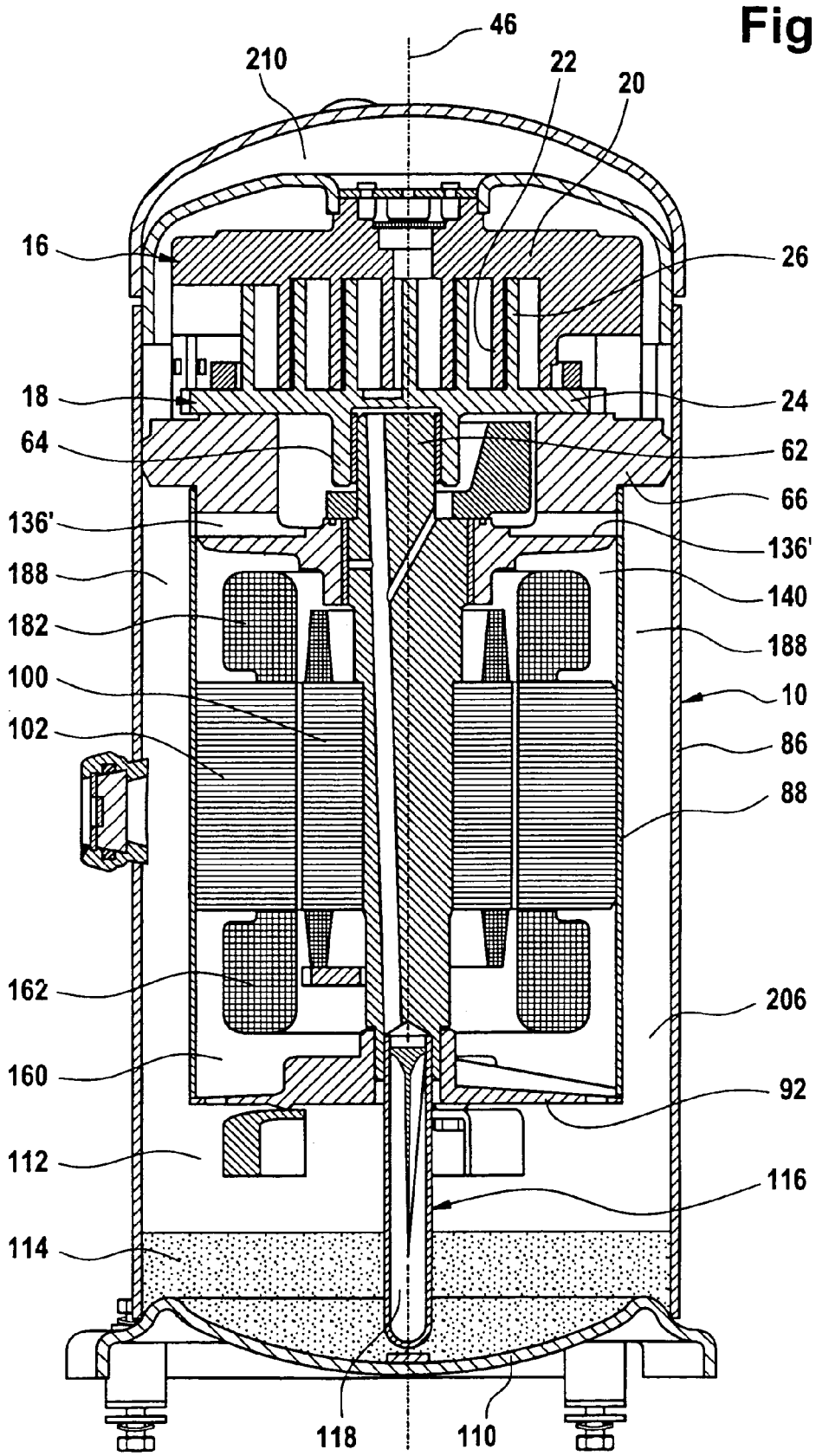
FIG. 9 shows a section similar to FIG. 2 through a third embodiment of an inventive compressor.

In a third embodiment of an inventive compressor, illustrated in FIG. 9, those parts which are identical to those of the first embodiment are given the same reference numerals and so reference can be made in full to the comments concerning the first embodiment.

In contrast to the first and second embodiments, the discharge channels 136' of the third embodiment do not extend such that the oil enters the space 140 but rather through the first bearing member 66 and through the casing 88 in a radial direction in relation to the central axis 46 outwards to such an extent that the oil enters the space 188 and, in it, can flow, preferably through the free space 206, to the oil sump 114 in the free space 112 together with the oil separated in the space 188.

What is claimed is:

1. Compressor for refrigerant, comprising:

an outer housing, a scroll compressor arranged in the outer housing and having a first compressor member arranged stationarily in the outer housing and a second compressor member movable relative to the first compressor member, said compressor members each having a base and first and second scroll ribs, respectively, rising above the respective base, said ribs engaging in one another such that the second compressor member is movable relative to the first compressor member on an orbital path about a central axis for the purpose of compressing the refrigerant, a drive unit for the second compressor member with an eccentric drive, a drive shaft, a drive motor arranged in a motor housing and having drawn-in refrigerant flowing through said drive motor, the refrigerant after flowing through said drive motor exiting from said motor housing, through an exit opening of said motor housing facing said outer housing and defining a space between said outer housing and said motor housing, into a section of said space and flowing through an oil separator prior to entering the scroll compressor, said oil separator being arranged inside the outer housing in said space between the outer housing and said motor housing, said refrigerant when entering said oil separator experiencing a deflection in an azimuthal direction in relation to the central axis caused by a deflection unit having at least one deflection surface arranged opposite the exit opening in said space and said refrigerant being guided in said azimuthal direction by an inner wall face of said outer housing and an outer wall face of said motor housing in order to deposit oil thereon.

2. Compressor as defined in claim 1, wherein the oil separator is arranged in said space between the outer housing and the drive unit in a direction transverse to the central axis.

3. Compressor as defined in claim 2, wherein the space surrounds the drive unit.

4. Compressor as defined in claim 2, wherein oil separated by the oil separator moves in the direction of an oil sump and refrigerant flows in the direction of an intake chamber of the scroll compressor.

5. Compressor as defined in claim 2, wherein refrigerant enters the space after cooling the drive motor.

6. Compressor as defined in claim 1, wherein the space between the outer housing and the drive unit extends essentially over an entire extension of the drive unit in a direction parallel to the central axis.

7. Compressor as defined in claim 1, further comprising:

a bearing unit for the drive shaft, said bearing unit comprising a first bearing member connected to the outer housing, wherein the oil separator is arranged at least in sections on an outer side of the first bearing member, wherein the oil separator is arranged at least in sections on an outer side of the first bearing member.

8. Compressor as defined in claim 7, wherein the oil separator is arranged so as to surround the first bearing member at least in sections.

9. Compressor as defined in claim 1, wherein the oil separator is arranged at least in sections on an outer side of the motor housing.

10. Compressor as defined in claim 9, wherein the oil separator is arranged so as to surround the motor housing at least in sections.

11. Compressor as defined in claim 1, wherein the oil separator uses part of the space located between the outer housing and the drive unit.

12. Compressor as defined in claim 11, wherein the space between the outer housing and the drive unit used by the oil separator is an annular space.

13. Compressor as defined in claim 1, wherein the refrigerant flows in the oil separator along the inner wall surface of the outer housing.

14. Compressor as defined in claim 1, wherein oil settling in the oil separator flows into an oil sump on a path extending outside the motor housing.

15. Compressor as defined in claim 14, further comprising:

a bearing unit for the drive shaft, said bearing unit comprising a first bearing member connected to the outer housing, wherein the oil sump is arranged in the outer housing on a side of the drive motor located opposite the first bearing member.

16. Compressor as defined in claim 1, further comprising:

a bearing unit for the drive shaft, said bearing unit comprising a first bearing member connected to the outer housing, wherein the refrigerant flows around an outer side of the first bearing member on its way from the oil separator to an intake chamber of the scroll compressor.

17. Compressor as defined in claim 1, further comprising:

a bearing unit for the drive shaft, said bearing unit comprising a first bearing member connected to the outer housing, wherein the oil separator is located on a side of supporting arms facing an oil sump, said supporting arms connecting the first bearing member to the outer housing.

18. Compressor as defined in claim 17, wherein the refrigerant passes between the supporting arms in the direction of an intake chamber of the scroll compressor after flowing through the oil separator.

19. Compressor as defined in claim 1, wherein the refrigerant flows directly into the motor housing when entering the compressor and enters the oil separator after flowing through the motor housing.

20. Compressor as defined in claim 1, wherein the refrigerant entering the motor housing experiences a deflection in at least one azimuthal direction.

21. Compressor as defined in claim 1, wherein the refrigerant enters the motor housing at the level of a first winding head when seen in the direction of the central axis.

22. Compressor as defined in claim 1, wherein the refrigerant, when seen in the direction of the central axis, flows through the drive motor from the first winding head in the direction of a second winding head.

23. Compressor as defined in claim 26, wherein the refrigerant exits from the motor housing at the level of the second winding head.

24. Compressor as defined in claim 1, wherein oil separating in the motor housing exits from the motor housing through oil discharge openings in a base of the motor housing in order to reach an oil sump.

25. Compressor as defined in claim 1, further comprising:

a bearing unit for the drive shaft, said bearing unit comprising a first bearing member connected to the outer housing, wherein the first bearing member has an oil guide for oil used for the lubrication of the eccentric drive.

26. Compressor as defined in claim 25, wherein the oil guide means opens into an interior space of the motor housing.

27. Compressor as defined in claim 26, wherein considerable portions of the oil are conveyed to the oil separator by the refrigerant flowing through the interior space of the motor housing.

28. Compressor as defined in claim 25, wherein the oil guide opens into the space.

29. Compressor as defined in claim 1, wherein the drive shaft has a bore for lubricating oil.

30. Compressor as defined in claim 29, further comprising:

a bearing unit for the drive shaft, said bearing unit comprising a first bearing member connected to the outer housing, wherein a lubrication of a rotary bearing for the drive shaft in the first bearing member is brought about via the bore for lubricating oil.

31. Compressor as defined in claim 29, wherein a lubrication of the eccentric drive is brought about via the bore for lubricating oil.

32. Compressor for refrigerant, comprising:

an outer housing, a scroll compressor arranged in the outer housing and having a first compressor member arranged stationarily in the outer housing and a second compressor member movable relative to the first compressor member, said compressor members each having a base and first and second scroll ribs, respectively, rising above the respective base, said ribs engaging in one another such that the second compressor member is movable relative to the first compressor member on an orbital path about a central axis for the purpose of compressing the refrigerant, a drive unit for the second compressor member with an eccentric drive, a drive shaft, a drive motor arranged in a motor housing, a flow path for drawn-in refrigerant, said flow path guiding said drawn-in refrigerant into said motor housing, around said drive motor, and from said motor housing into a space between said motor housing and said outer housing prior to said refrigerant entering said scroll compressor, an oil separator arranged in said space between the outer housing and said motor housing in said flow path prior to the scroll compressor, wherein the refrigerant experiences a deflection in opposite azimuthal directions in relation to the central axis when entering the oil separator.

33. Compressor for refrigerant, comprising:

an outer housing, a scroll compressor arranged in the outer housing and having a first compressor member arranged stationarily in the outer housing and a second compressor member movable relative to the first compressor member, said compressor members each having a base and first and second scroll ribs, respectively, rising above the respective base, said ribs engaging in one another such that the second compressor member is movable relative to the first compressor member on an orbital path about a central axis for the purpose of compressing the refrigerant, a drive unit for the second compressor member with an eccentric drive, a drive shaft, a drive motor arranged in a motor housing, a flow path for drawn-in refrigerant, said flow path guiding said drawn-in refrigerant into said motor housing, around said drive motor, and from said motor housing into a space between said motor housing and said outer housing prior to said refrigerant entering said scroll compressor, an oil separator arranged in said space between the outer housing and said motor housing in said flow path prior to the scroll compressor, wherein the refrigerant entering the motor housing experiences a deflection in opposite azimuthal directions.

34. Compressor as defined in claim 33, wherein the refrigerant experiences a deflection in an azimuthal direction in relation to the central axis when entering the oil separator.

35. Compressor as defined in claim 33, wherein the refrigerant is guided in the oil separator essentially on an azimuthal path around the central axis.

* * * * *

UNITED STATES PATENT AND TRADEMARK OFFICE

CERTIFICATE OF CORRECTION

PATENT NO. : 6,960,070 B2
DATED : November 1, 2005
INVENTOR(S) : Kammhoff et al.

It is certified that error appears in the above-identified patent and that said Letters Patent is hereby corrected as shown below:

Column 11,
Line 59, “as defined in claim 1” should read -- as defined in claim 21 --.
Line 63, “as defined in claim 26” should read -- as defined in claim 22 --.

Signed and Sealed this

Tenth Day of January, 2006

JON W. DUDAS
*Director of the United States Patent and Trademark Office*